US005181827A

United States Patent [19]

Pellow et al.

[11] Patent Number: 5,181,827

[45] Date of Patent: Jan. 26, 1993

[54] GAS TURBINE ENGINE SHROUD RING MOUNTING

[75] Inventors: Terence R. Pellow, Watford; Ronald A. Midgley, Weston-on-Trent, both of England

[73] Assignee: Rolls-Royce plc, London, England

[21] Appl. No.: 450,440

[22] Filed: Nov. 30, 1982

[30] Foreign Application Priority Data

Dec. 30, 1981 [GB] United Kingdom ..... 8139038

[51] Int. Cl.[5] ..... F01D 11/08

[52] U.S. Cl. ..... 415/173.3; 415/134

[58] Field of Search ..... 415/113, 114, 115, 127, 415/128, 136, 138, 170 R, 172 A, 173 R, 174, 197, 134

[56] References Cited

U.S. PATENT DOCUMENTS

| | | | |
|---|---|---|---|
| 3,778,184 | 12/1973 | Wood | 415/136 |
| 3,932,056 | 1/1976 | Tai | 415/174 |
| 4,199,300 | 4/1980 | Tubbs | 415/114 |
| 4,207,027 | 6/1980 | Barry et al. | 415/115 |
| 4,273,824 | 6/1981 | McComas et al. | 415/174 |

FOREIGN PATENT DOCUMENTS

| | | | |
|---|---|---|---|
| 2051962 | 1/1981 | United Kingdom | 415/174 |

*Primary Examiner*—Stephen C. Bentley

*Attorney, Agent, or Firm*—Cushman, Darby & Cushman

[57] ABSTRACT

A turbine suitable for a gas turbine engine is provided with a stage of rotary aerofoil blades which is surrounded by a shroud ring made of silicon nitride. In order to minimize load transfer between the shroud ring and the turbine casing the shroud ring is radially supported by and radially spaced apart from the turbine casing by a woven wire mesh array.

6 Claims, 2 Drawing Sheets

GAS TURBINE ENGINE SHROUD RING MOUNTING

This invention relates to the mounting of a shroud ring in a gas turbine engine.

Turbines suitable for gas turbine engines conventionally comprise a casing enclosing alternate stages of rotary and stationary aerofoil blades positioned in an annular gas passage. In order to ensure the efficient operation of such turbines, it is important that the clearances between the tips of the rotary aerofoil blades and the radially outer wall of the gas passage are as small as possible. If the clearances are too great, excessive gas leakage occurs across the blade tips, thereby reducing turbine efficiency. There is a danger however that if clearances are reduced so as to reduce leakage, it is likely that under certain turbine operating conditions, the tips of the rotary blades will make contact with the gas passage wall, thereby causing both blade and wall damage.

In an attempt to ensure that optimum blade tip clearances are achieved and maintained with minimal gas leakage across them, it has been suggested to surround a stage of rotary aerofoil blades with a shroud ring. The shroud ring is conventionally attached to the turbine casing in such a manner that it provides a radially inner surface which defines a portion of the radially outer wall of the turbine annular gas passage. Since the shroud ring is an item which is comparatively simple to manufacture, it may be closely toleranced so as to ensure that rotary aerofoil blade tip clearances are as near to the optimum as is possible. However, shroud rings still present problems in ensuring that optimum tip clearances are maintained during turbine operation. These problems are associated mainly with the differing rates of thermal expansion of the turbine casing, the shroud ring and the rotary aerofoil blade assembly. Thus, for instance, although the turbine casing and shroud ring may be formed from materials having the same or similar rates of thermal expansion, the difference in their masses and the temperatures to which they are exposed during turbine operation ensures that they usually expand and contract at differing rates. Consequently there is a danger of the shroud ring and possibly the turbine casing being distorted. Similarly the shroud ring and rotary aerofoil blade stage are likely to radially expand and contract at differing rates, thereby causing variations in the tip clearances of the rotary aerofoil blades.

It is an object of the present invention to provide a turbine which includes a turbine casing, shroud ring and rotary aerofoil blade stage which is so adapted as to minimize variations in the clearances between the tips of the rotary aerofoil blades and the shroud ring during turbine operation.

According to the present invention a turbine suitable for a gas turbine engine comprises a turbine casing enclosing means adapted to cooperate with said casing to define an annular gas passage, a stage of rotary aerofoil blades positioned within said annular gas passage and a shroud ring surrounding but not engaging said rotary aerofoil blades, said shroud ring comprising a ceramic material, adapted to constitute a portion of the radially outer wall of said annular gas passage and both radially supported from and radially spaced apart from said turbine casing by a continuous or segmented woven wire mesh array which is supported in turn from said turbine casing.

Since the shroud ring is radially supported from and radially spaced apart from the turbine casing by a woven wire mesh array, it is free to move relative to the casing over a restricted range. In particular the shroud ring and casing may expand or contract at differing rates without any significant load transfer taking place between them.

The lack of any significant load transfer between the shroud ring and casing under a large range of thermal conditions means that the shroud ring may comprise a ceramic material which, under normal circumstances would not tolerate direct attachment to the casing. Since ceramics generally have low rates of thermal expansion, the use of a shroud ring which comprises a ceramic material is highly advantageous in the maintenance of small blade tip clearances which vary little during turbine operation. Thus while the rotary aerofoil blade stage may expand and contract radially during turbine operation, the tip clearances between the rotary aerofoil blades and shroud ring vary over a smaller range than is the case when conventional metallic shroud rings are utilized.

The turbine casing is preferably axially divided radially outwardly of the rotary aerofoil blade stage so as to define a circumferentially extending housing adapted to accommodate said shroud ring comprising a ceramic material and is additionally adapted to define an annular chamber radially outwardly of said shroud ring housing, said woven wire mesh array being located within said annular chamber between the radially outer wall of said chamber and the radially outer surface of said shroud ring, means being provided to axially retain said woven wire mesh array in position in said annular chamber.

The shroud ring may comprise a metallic ring-shaped support member which is adapted to carry the ceramic portion of the shroud ring and also engage the woven wire mesh array.

Said shroud ring preferably comprises an annular silicon nitride portion.

Said shroud ring may additionally comprise a further ceramic material interposed between said silicon nitride portion and said ring shaped support member.

Said further ceramic material may be so adapted that insulating air gaps are defined between said further ceramic material and each of said silicon nitride portion and said ring-shaped support member.

The invention will now be described by way of example with reference to the accompanying drawings in which.

Figure 1:
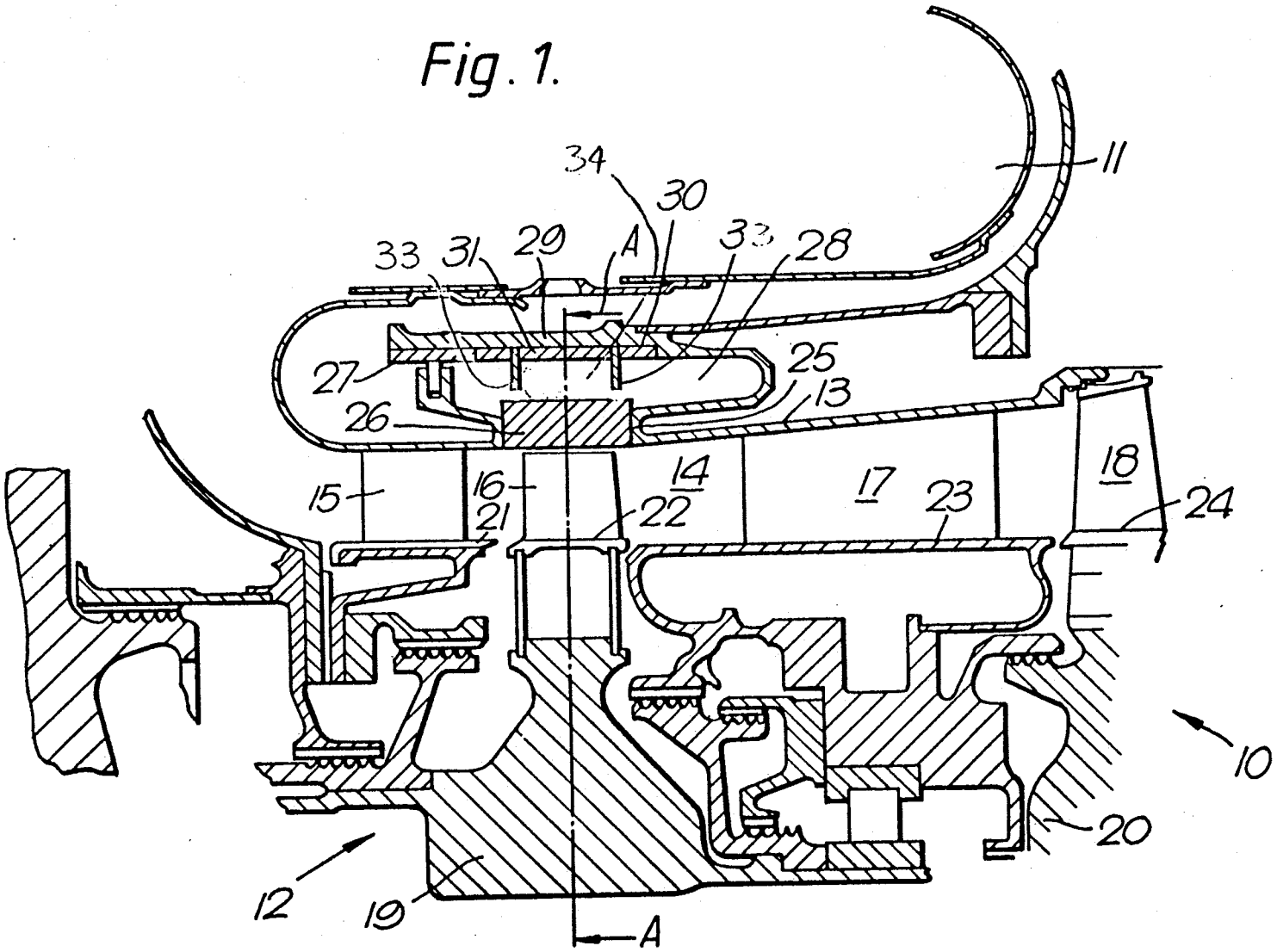
FIG. 1 is a sectioned side view of a portion of a gas turbine engine incorporating a turbine in accordance with the present invention.
Figure 2:
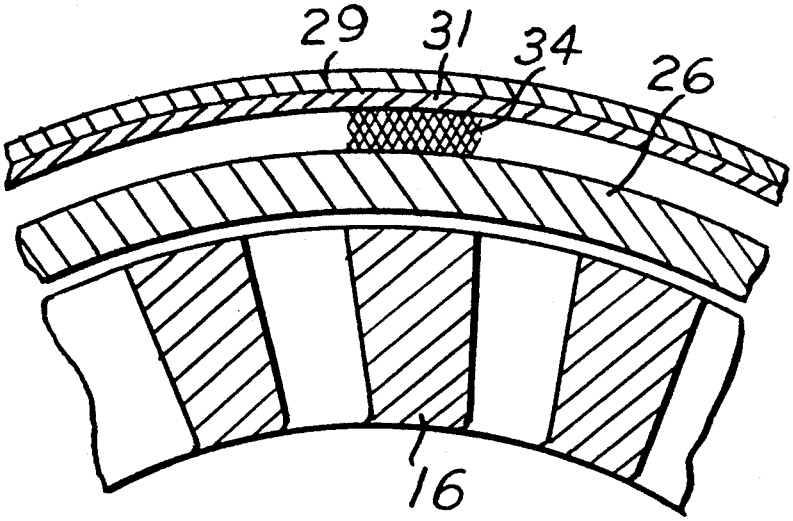
FIG.2 is a view on section line A—A of FIG.1.

With reference to FIG. 1 a gas turbine engine portion generally indicated at 10 comprises a combustion chamber 11 and a turbine 12. The turbine 12 in turn comprises a casing 13 which defines the radially outer wall of an annular gas passage 14. The passage 14 contains, in flow series, stages of stationary nozzle guide vanes 15, rotary high pressure aerofoil blades 16, low pressure stator vanes 17 and rotary low pressure aerofoil blades 18. The stages of rotary aerofoil blades 16 and 18 are mounted for rotation on discs 19 and 20 respectively. The nozzle guide vanes 15 and rotary aerofoil blades 16 constitute the high pressure section of the turbine 10 and the stator vanes 17 and rotary aerofoil blades 18 the low pressure section. The platforms 21, 22, 23, and 24 of the nozzle guide vanes 15, rotary aerofoil blades 16, stator vanes 17 and rotary aerofoil blades 18 respectively define the radially inner wall of the gas passage 14.

The turbine casing 13 is axially divided radially outwardly of the rotary high pressure aerofoil blade array 16 to provide a circumferentially extending housing 25 for a silicon nitride shroud ring 26. The housing 25 is of sufficient axial length to permit the shroud ring 26 to float radially with respect to the axis of rotation of the turbine 10. The walls of the housing 25 extend radially outwardly to cooperate with a generally T-shaped cross-section ring 27 so that together they define an annular chamber 28. The radially outer wall 29 of the chamber 28 is provided with a recess 30 which accommodates a support ring 31 carrying two radially inwardly extending axially spaced apart flanges 33. The flanges 33 retain an annular woven wire mesh array 34 which extends radially inwardly of the flange 33 to engage and support the radially outer surface of the shroud ring 26 so that the shroud ring 26 is radially spaced apart from the turbine casing 13 but is located axially by the walls of the housing 25. Thus the woven wire mesh array 34 provides the sole radial support for the shroud ring 26.

The woven wire mesh array 34 supports the shroud ring 26 from the turbine casing 13 in such a manner that any radial growth or contraction of the turbine casing 13 due to thermal expansion or contraction is not transmitted to the shroud ring 26. Thus any alterations in the radial distance between the turbine casing 13 and the shroud ring 26 arising from relative radial expansion or contraction results in the woven wire mesh array 34 flexing so as to accommodate those alterations. Consequently little load transfer occurs between the turbine casing 13 and the shroud ring 26, thereby permitting the shroud ring 26 to be formed from a brittle material such as silicon nitride. It will be appreciated, however, that the present invention is generally applicable to shroud rings comprising any convenient ceramic material. It will also be appreciated that the woven wire mesh array 34 could be in the form of discrete segments instead of a continuous ring.

Since ceramics in general and silicon nitride in particular have low coefficients of thermal expansion, they can be expected to dimensionally alter very little during turbine operation. It follows from this that during turbine operation, the clearance between the tips of the rotary aerofoil blades 16 and the shroud ring 26 effectively only vary by the amount that the blades 16 and their associated disc 19 thermally expand and contract in a radial direction. Thus tip clearances are unaffected by the amount that the turbine casing 13 may thermally expand or contract during turbine operation.

Contact between the shroud ring 26 and the housing 25 may be sufficient to provide an axial gas seal across the shroud ring 26. However during the operation of the turbine 12 some of the hot exhaust gases directed by the stage of nozzle guide vanes 15 onto the stage of rotary aerofoil blades 16 may escape through the housing 25 and across into the annular chamber 28. This may be prevented by providing resilient seals such as brush seals between the flanges 33 and the shroud ring 26. Alternatively the flanges 33 may be so axially spaced apart and radially elongated that they embrace the shroud ring 26 in radially sliding engagement.

Figure 3:
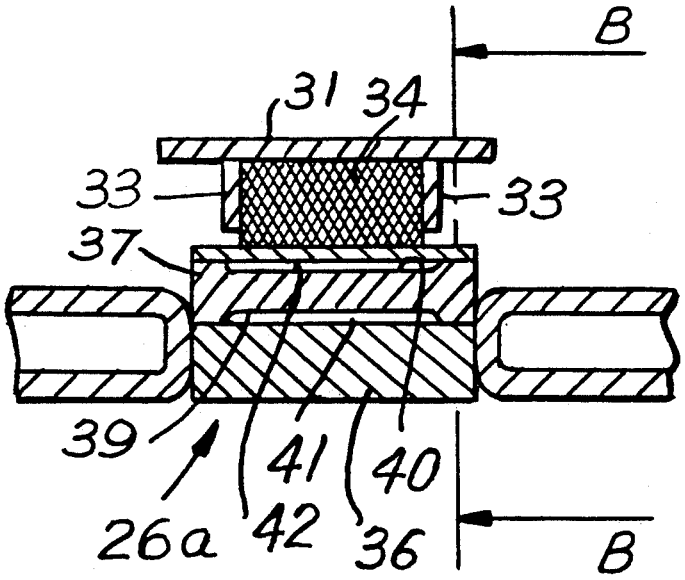
FIG. 3 is a sectioned side view of an alternative form of the present invention.
Figure 4:
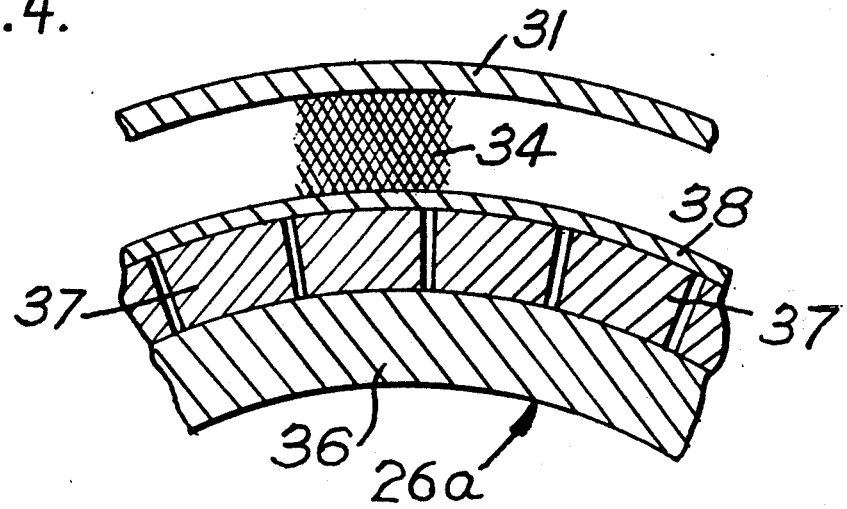
FIG. 4 is a view on section line B—B of FIG. 3.

In certain instances, the temperatures which are encountered in a gas turbine engine turbine are so high that the silicon nitride heats up to such an extent that the woven wire mesh array 34 may be in danger of heat damage. In such circumstances it is preferred to utilize a shroud ring which has improved heat insulation properties. Such a shroud ring **26*a* is shown in FIGS. 3 and 4**.

The shroud ring **26*a* comprises a silicon nitride ring portion 36 which is similar to the previously described shroud ring 26. However the radially outer surface of the silicon nitride ring portion 36 is provided with an annular array of ceramic blocks 37. The annular array of ceramic blocks 37 is surrounded in turn by a metallic ring-shaped support member 38 which serves to retain the ceramic blocks 37 in position around the silicon nitride ring portion 36**.

The ceramic blocks 37 are provided with cut-out portions 39 and 40 on their radially inner and outer surfaces respectively. These cut-out portions 39 and 40 cooperate with the silicon carbide ring portion 36 and the ring shaped support member 38 respectively to define insulating air gaps 41 and 42. Thus the air gaps 41 and 42 together with the ceramic blocks 37 ensure that the woven wire mesh array 34 does not overheat.

Although the present invention has been described with reference to the high pressure stage of a turbine, it will be appreciated that the invention is in fact applicable to any turbine stage.

We claim:

1. A turbine for a gas turbine engine, said turbine having a turbine casing, means cooperating with said turbine casing to define an annular gas passage, a stage of rotary aerofoil blades positioned within said annular passage and having an axis of rotation, a shroud ring made from a ceramic material surrounding and spaced from said aerofoil blades, said shroud ring being capable of floating radially with respect to said axis of rotation, said turbine casing being axially divided radially outwardly of said stage to define a circumferentially extending housing accommodating said shroud ring and additionally defining an annular chamber with an outer wall spaced radially outwardly of said shroud ring, and means radially supporting and radially spacing apart said shroud ring from said turbine casing, the improvement in said last-mentioned means comprising:

a pair of axially spaced apart flanges extending radially inwardly from said outer wall toward said shroud ring and defining an annular space surrounding said shroud ring;

and a woven wire mesh array located within and filling said space between said outer wall and said shroud ring and between said axially spaced apart flanges, said flanges being capable of restraining said woven wire mesh array from axial movement.

2. A turbine suitable for a gas turbine engine as claimed in claim 1, wherein said woven wire mesh array is segmentally divided.

3. A turbine suitable for a gas turbine engine as claimed in claim 1 wherein said shroud ring includes a ring-shaped support member which carries said shroud ring and also engages said woven wire mesh array.

4. A turbine suitable for a gas turbine engine as claimed in claim 3 wherein said shroud ring comprises an annular silicon nitride portion adjacent said stage of rotary aerofoil blades.

5. A turbine suitable for a gas turbine engine as claimed in claim 4 wherein said shroud ring additionally comprises a further ceramic material portion interposed between said silicon nitride portion and said ring shaped support member.

6. A turbine suitable for a gas turbine engine as claimed in claim 5 wherein said further ceramic material portion is configured to provide insulating air gaps between said further ceramic material portion and said silicon nitride portion of said shroud ring and said ring-shaped support member.

* * * * *